US010062953B2

(12) United States Patent
Noh

(10) Patent No.: US 10,062,953 B2
(45) Date of Patent: Aug. 28, 2018

(54) SATELLITE ANTENNA

(71) Applicant: Intellian Technologies INC., Pyeongtaek-si (KR)

(72) Inventor: Jung Pil Noh, Osan-si (KR)

(73) Assignee: INTELLIAN TECHNOLOGIES INC., Pyeongtaek-si (KR)

( * ) Notice: Subject to any disclaimer, the term of this patent is extended or adjusted under 35 U.S.C. 154(b) by 0 days.

(21) Appl. No.: 15/321,415

(22) PCT Filed: Jun. 12, 2015

(86) PCT No.: PCT/KR2015/005940

§ 371 (c)(1),
(2) Date: Dec. 22, 2016

(87) PCT Pub. No.: WO2015/199368

PCT Pub. Date: Dec. 30, 2015

(65) Prior Publication Data

US 2017/0155183 A1 Jun. 1, 2017

(30) Foreign Application Priority Data

Jun. 23, 2014 (KR) ..... 10-2014-0076220

(51) Int. Cl.
*H01Q 1/18* (2006.01)
*H01Q 1/12* (2006.01)
(Continued)

(52) U.S. Cl.
CPC ..... *H01Q 1/18* (2013.01); *H01Q 1/12* (2013.01); *H01Q 1/288* (2013.01); *H01Q 1/32* (2013.01);
(Continued)

(58) Field of Classification Search
CPC .. H01Q 1/18; H01Q 1/28; H01Q 3/08; H01Q 15/14
(Continued)

(56) References Cited

U.S. PATENT DOCUMENTS 3,239,839 A 3/1966 Banche et al.
5,351,060 A * 9/1994 Bayne ..... H01Q 1/1257 342/359
(Continued)

FOREIGN PATENT DOCUMENTS

CN 101017923 8/2007
JP 06132716 5/1994
(Continued)

OTHER PUBLICATIONS

International Search Report—PCT/KR2015/005940 dated Jul. 6, 2015.
European Search Report—European Application No. 15811131.0, dated Jan. 16, 2018, citing WO 2013/150434, CN 101 017 923, JP 2005 184464, U.S. Pat. No. 3,239,839 and KR 2012 0077287.

*Primary Examiner* — Huedung Mancuso
(74) *Attorney, Agent, or Firm* — Cantor Colburn LLP

(57) ABSTRACT

There is provided a satellite antenna including: a reflector which is directed in a direction toward a target satellite and receives a predetermined satellite signal; and a balance weight module which is mounted on a rear surface of the reflector, in which the balance weight module includes a guide movable balance weight, a guide which defines a movement route along which the guide movable balance weight is moved in a state in which the guide movable balance weight is coupled to the guide, and a fixing member which selectively couples the guide movable balance weight at one side of the guide. By using the satellite antenna according to the present invention, it is possible to easily and quickly perform an operation of adjusting weight balance of the reflector and to prevent a safety accident.

7 Claims, 7 Drawing Sheets

(51) Int. Cl.

| | |
|---|---|
| ***H01Q 3/08*** | (2006.01) |
| ***H01Q 1/28*** | (2006.01) |
| ***H01Q 15/14*** | (2006.01) |
| ***H01Q 1/32*** | (2006.01) |
| ***H01Q 1/34*** | (2006.01) |
| ***H01Q 19/10*** | (2006.01) |

(52) U.S. Cl.
CPC ..... *H01Q 1/34* (2013.01); *H01Q 3/08* (2013.01); *H01Q 15/14* (2013.01); *H01Q 19/10* (2013.01)

(58) Field of Classification Search
USPC ..... 343/839
See application file for complete search history.

(56) References Cited

U.S. PATENT DOCUMENTS 5,414,435 A * 5/1995 Wolf ..... H01Q 1/1235 280/762
2010/0188304 A1* 7/2010 Clymer ..... H01Q 1/185 343/753

FOREIGN PATENT DOCUMENTS

| | | |
|---|---|---|
| JP | 2001144516 | 5/2001 |
| JP | 2005184464 | 7/2005 |
| KR | 1020060124063 | 12/2006 |
| KR | 1020120077287 | 7/2012 |
| WO | 2013150434 | 10/2013 |

* cited by examiner

SATELLITE ANTENNA

TECHNICAL FIELD

The present invention relates to a satellite antenna, and more particularly, to a satellite antenna provided with a balance weight module that allows an operation of adjusting a center of gravity of a reflector to be easily performed.

BACKGROUND ART

In general, as a satellite antenna installed on a moving body such as a vehicle, a ship, or a marine structure, a directional satellite antenna is widely used.

The directional satellite antenna has characteristics in that the directional satellite antenna irradiates intensive radio waves only in a particular direction or has high receiving sensitivity with respect to the radio waves in the particular direction. In the case of the directional satellite antenna, a reflector needs to accurately track and to be directed toward a position of a satellite so as to maintain a state of excellently receiving the radio waves, even in an unrest situation such as a movement of a receiver, a direction change, high ocean waves, and various disturbances. Therefore, the satellite antenna is equipped with a satellite tracking device or the like, and as a result, a direction and a rotation of the reflector are controlled.

In this case, if the reflector has an asymmetric weight, an error of control for tracking the satellite exceeds an acceptable range or the direction is controlled in response to a wrong direction. However, even though the reflector itself of the satellite antenna is designed to have a uniform weight, various types of components or devices, for signal transmitting and receiving devices, satellite tracking automatic control devices, a low noise block-down (LNB) converter, and the like, are mounted on a rear surface of the reflector, and as a result, the entire reflector has a non-uniform weight. Therefore, several balance weights are also mounted in order to adjust overall weight balance of the reflector.

However, in the case of the satellite antenna in the related art, the several balance weights needs to be separated one by one from the reflector or a frame on which the reflector is mounted, and then the balance weights needs to be coupled at readjustment positions in order to readjust the weight balance of the reflector, and the operation of adjusting the weight balance is manually performed, and as a result, there are many mistakes such as a number of changes in readjustment positions of one balance weight. Therefore, there is a problem in that the operation of adjusting the weight balance of the reflector is poor in workability because of enormous efforts, long working time, and the like caused by a number of repetitive operations.

In addition, because the balance weight is relatively heavy in weight, considerably heavy labor is required to support and lift up the balance weight. Further, it is difficult to accurately hold the balance weight and perform the work when the balance weight is mounted to be tilted with respect to a horizontal plane. As a result, there are problems in that workability is poor, and there is a high risk that a safety accident will occur.

As literature in the related art, there is Korean Patent Application Laid-Open No. 10-2006-0124063 (entitled "Three-axis Satellite Antenna", published on Dec. 5, 2006)

DISCLOSURE

Technical Problem

An aspect of the present invention provides a satellite antenna which is provided with a balance weight module capable of allowing an operation of readjusting a position of a guide movable balance weight for adjusting weight balance of a reflector to be easily and quickly performed, and capable of preventing a risk of a safety accident.

Technical Solution

According to an aspect of the present invention, there is provided a satellite antenna including: a reflector which is directed in a direction toward a target satellite and receives a predetermined satellite signal; and a balance weight module which is mounted on a rear surface of the reflector, in which the balance weight module may include a guide movable balance weight, a guide which defines a movement route along which the guide movable balance weight is moved in a state in which the guide movable balance weight is coupled to the guide, and a fixing member which selectively couples the guide movable balance weight at one side of the guide.

The guide may include a guide panel which is provided with guide rails into which both sides of the guide movable balance weight are movably fitted, respectively, and which define the movement route of the guide movable balance weight.

An oblong hole, which has a hole shape elongated along the movement route of the guide movable balance weight, may be formed in the guide rail, and the guide movable balance weight may be provided with a first position fixing member which is movably fitted into the oblong hole of the guide rail and fixed to the guide panel.

The satellite antenna may further include anti-abrasion members which are attached to the guide panel, the guide rail, or the guide movable balance weight so as to be interposed between the guide panel and the guide movable balance weight and between the guide rail and the guide movable balance weight.

The guide movable balance weight may include a first balance weight which is coupled to the guide rail and moved along the guide rail, and a second balance weight which is moved relative to the first balance weight in a direction different from a direction in which the first balance weight is moved in a state in which the second balance weight is coupled to the first balance weight.

The movement direction of the second balance weight may be perpendicular to the movement direction of the first balance weight.

A groove or hole-shaped fastening portion may be formed in at least one of the first balance weight and the second balance weight, and the first balance weight and the second balance weight may be fastened and fixed to each other by a second position fixing member fitted into the fastening portion.

The balance weight module may further include a detachable balance weight formed on one surface of the guide panel which faces the guide movable balance weight based on the guide panel.

The satellite antenna may further include a balance weight bracket which is formed at a rear side of the reflector and supports the balance weight module.

Advantageous Effects

As set forth above, according to exemplary embodiments of the invention, the present invention is advantageous in that it is possible to move the guide movable balance weight along the guide in a state in which the guide movable balance weight is coupled to the guide, and as a result, it is possible to easily and quickly perform an operation of adjusting weight balance of the reflector, and to prevent a risk of a safety accident caused by a fall of the balance weight or the like.

BEST MODE

Figure 1:
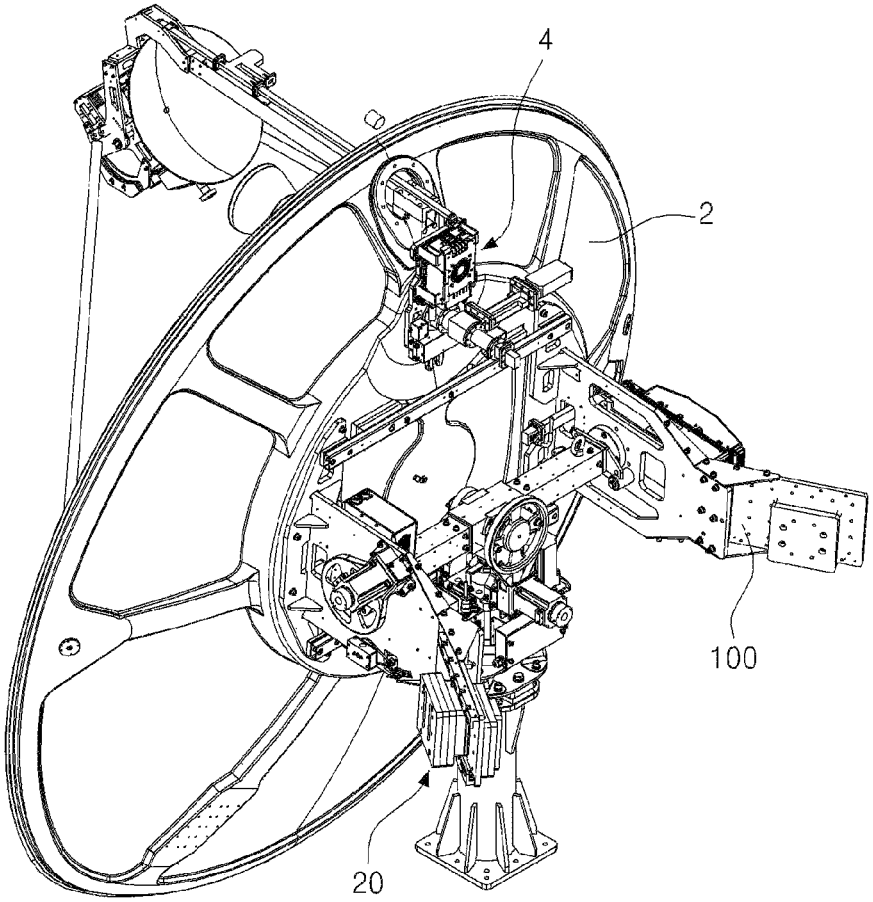
FIG. 1 is a rear perspective view of a reflector of a satellite antenna according to an exemplary embodiment of the present invention.
Figure 2:
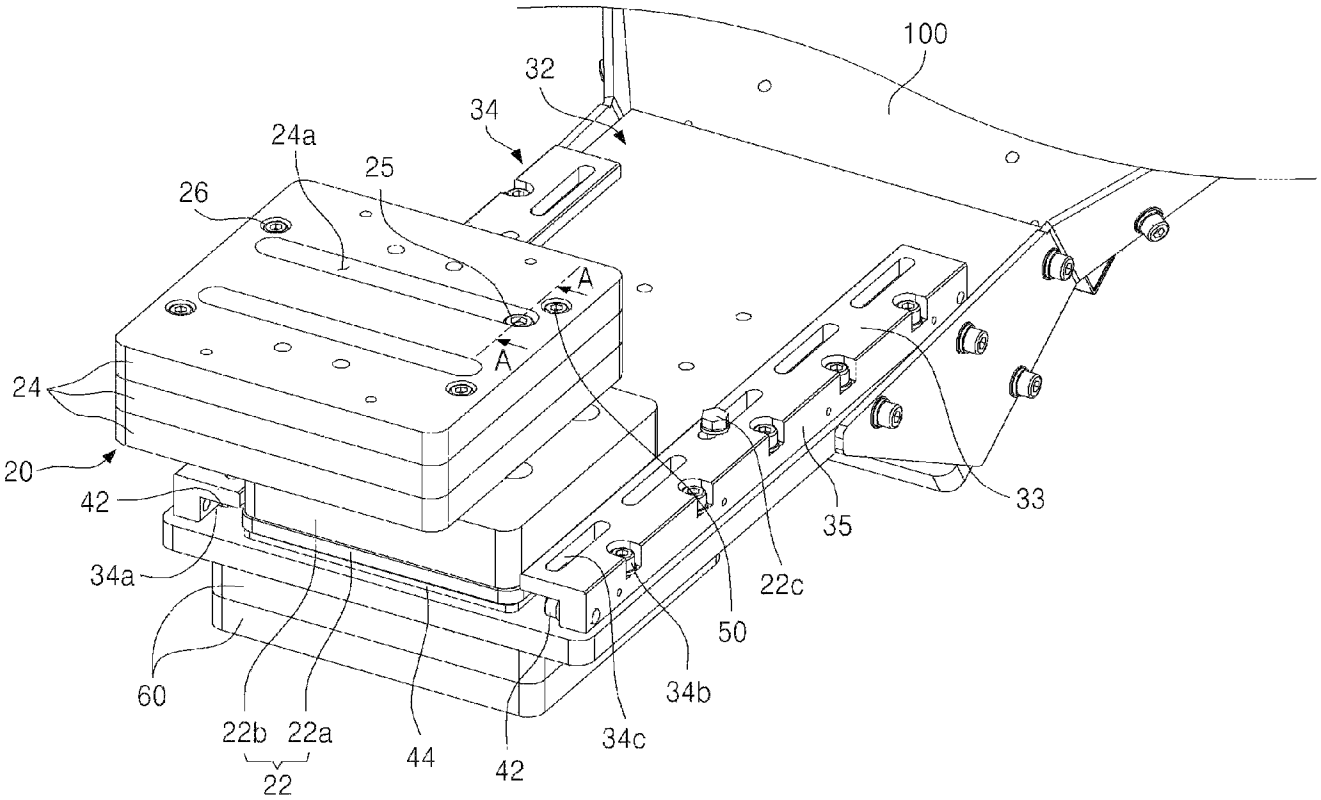
FIG. 2 is a perspective view of a balance weight module of the satellite antenna according to the exemplary embodiment of the present invention.
Figure 3:
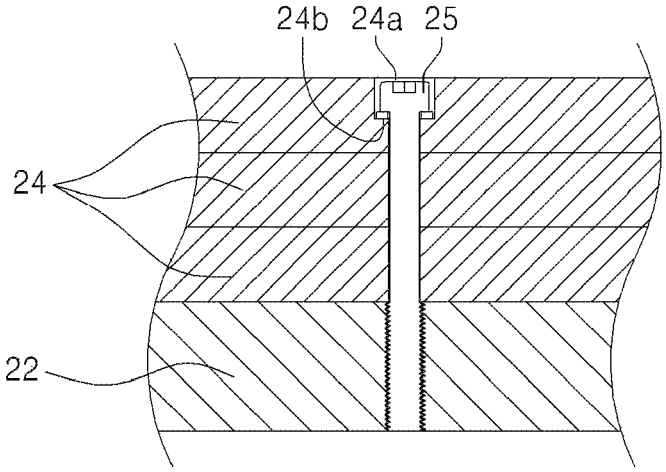
FIG. 3 is an exploded perspective view of the balance weight module illustrated in FIG. 2.
Figure 4:
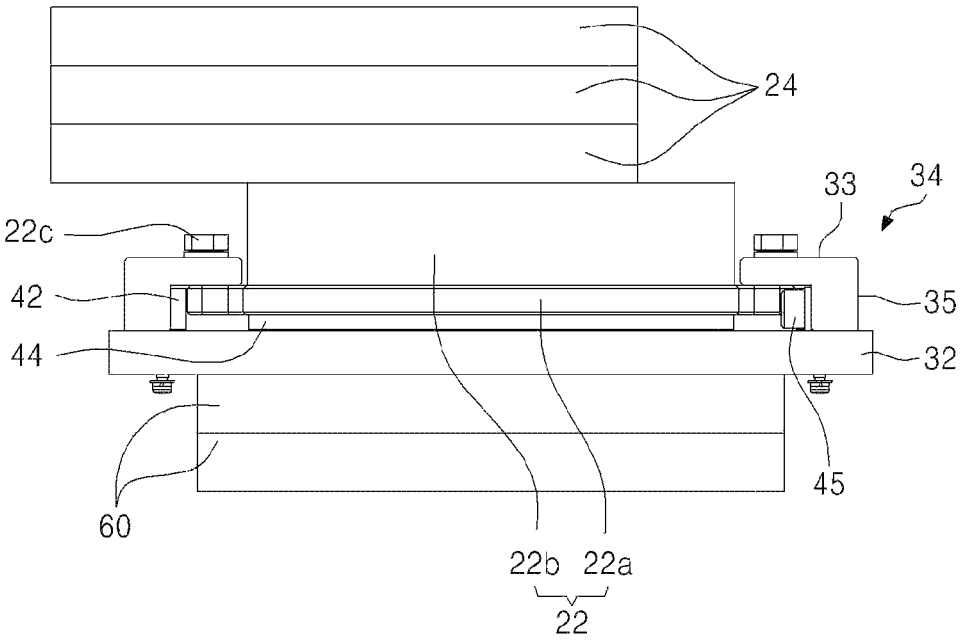
FIG. 4 is a front view of the balance weight module illustrated in FIG. 2.

In order to sufficiently understand the object that will be achieved by the present invention, advantages in operation of the present invention, and implementation of the present invention, reference needs to be made to the accompanying drawings for illustrating an exemplary embodiment of the present invention and contents disclosed in the accompanying drawings.

Hereinafter, an exemplary embodiment of the present invention will be described in detail with reference to the accompanying drawings. However, in the description of the present invention, a description of a function or configuration already publicly known will be omitted in order to clearly define the subject matter of the present invention.

As illustrated in FIGS. 1 to 8, a satellite antenna according to an exemplary embodiment of the present invention may include a reflector 2 which has attached electronic components 4 that are directed in a direction toward a target satellite and receive predetermined satellite signals, and a balance weight module which is mounted on a rear surface of the reflector 2 and adjusts weight balance of the reflector 2 by increasing or decreasing a weight and adjusting a position of a center of gravity.

The balance weight module may include a guide movable balance weight 20 which is made of steel (Fe) or the like so as to impart predetermined weight properties, and particularly, the balance weight module may include a guide which defines a movement route 34*a* of the guide movable balance weight 20 so that the guide movable balance weight 20 may be moved along the movement route 34*a* in a state in which the guide movable balance weight 20 is coupled to the guide.

The guide may include a guide panel 32 having a pair of guide rails 34 with which both sides of the guide movable balance weight 20 are movably fitted and which defines the movement route 34*a* of the guide movable balance weight 20.

Each of the guide rails 34 has a longitudinal cross section formed approximately in a '⊣' shape, and may be elongated along the movement route 34*a*. That is, each of the guide rails 34 may include a vertical portion 35 which is coupled perpendicularly to the guide panel 32, and a horizontal portion 33 which is coupled to the vertical portion 35 so as to be in parallel with the guide panel 32 so that the movement route 34*a* is formed between the horizontal portion 33 and the guide panel 32.

Each of the guide rails 34 may be manufactured separately from the guide panel 32, and may have a plurality of screw fastening holes (not illustrated) formed along the movement route 34*a* so that each of the guide rails 34 may be fixed to the guide panel 32 by means of bolts or screws 34*b* and the like.

Oblong holes (hereinafter, referred to as 'first oblong hole 34*c*' for ease of description), which are elongated along the movement route 34*a*, are formed in each of the guide rails 34, and a position fixing member (hereinafter, referred to as 'first position fixing member 22*c*' for ease of description), which is fitted into the first oblong hole 34*c* of the guide rail 34 and may be moved along the movement route 34*a*, is integrally formed on the guide movable balance weight 20.

The plurality of first oblong holes 34*c* of the guide rail 34 may be formed in a line along the movement route 34*a*.

A head portion of the first position fixing member 22*c* of the guide movable balance weight 20 may be placed on the guide rail 34, the first position fixing member 22*c* may penetrate the guide movable balance weight 20, and an end of the first position fixing member 22*c* may be fastened and fixed to the guide rail 34 by means of bolts or screws or the like. That is, a position of the guide movable balance weight 20 is determined by fastening the guide movable balance weight 20 to the guide rail 34 by using the first position fixing member 22*c* on the guide rail 34 after determining a final position of the guide movable balance weight 20 on the guide rail 34.

The guide movable balance weight 20 may be configured to have various weights, materials, and shapes, and in the present invention, the guide movable balance weight 20 may have a panel shape because the guide movable balance weight 20 may be easily moved along the movement route 34*a* of the guide. The guide movable balance weight 20 is formed by stacking a plurality of plate-shaped members, and as a result, the weight thereof may be easily adjusted.

The guide movable balance weight 20 may include the first balance weight 22 which is coupled to the guide rails 34 and moved along the guide rails 34. The first balance weight 22 may be configured as a single member, or may be configured by stacking the plurality of plate-shaped members as illustrated.

The first balance weight 22 may include a first member 22*a* which is coupled to at least one guide rail 34, and one or two or more second members 22*b* which are stacked on and integrally coupled to the first member 22*a*.

The first member 22*a* of the first balance weight 22 may be formed as a thin panel or plate-shaped member so that the first member 22*a* is easily coupled to the at least one guide rail 34.

The first member 22*a* is formed to have a width wider than a width between the pair of guide rails 34 so that the first member 22*a* may be fitted into the movement route 34*a* of the at least one guide rail 34, and a plurality of screw fastening holes may be formed in a line along the movement route 34*a* at an edge of the first member 22*a* so that the first position fixing member 22*c* may be fastened to the screw fastening hole by means of a bolt or a screw.

The second member 22*b* of the first balance weight 22 is formed to have a width narrower than the width between the pair of guide rails 34, and formed to be thicker and heavier than the first member 22*a*, and the second member 22*b* may be stacked on the first member 22*a*. However, in some instances, the second member 22*b* may be formed to be thinner and lighter in weight than the first member 22*a*.

The guide movable balance weight 20 may further include a second balance weight 24 which is coupled to the first balance weight 22 so as to be movable relative to the first balance weight 22 in a direction different from a direction in which the first balance weight 22 is moved. Therefore, the guide movable balance weight 20 may be moved in various directions and then fixed, and as a result, it is possible to more easily and accurately correct the weight balance of the reflector 2.

In particular, the movement direction of the second balance weight 24 may be perpendicular to the movement direction of the first balance weight 22, and as a result, it is possible to more simply and easily perform a process of correcting the weight balance by using the guide movable balance weight 20.

The second balance weight 24 is formed by stacking one or two or more panel-shaped or plate-shaped members, and the respective plate-shaped members may have the same shape and weight or may have different shapes and weights. Further, the second balance weight 24 may have the same shape and weight as the first balance weight 22, or may have a shape and a weight different from those of the first balance weight 22.

Meanwhile, the plurality of stacked plate-shaped members may be coupled to each other by means of fastening members 26, such that the entire second balance weight 24 may be fixed and integrally moved. The number of stacked plate-shaped members may be increased or decreased.

A groove or hole-shaped fastening portion 24*a* may be formed in one of the first balance weight 22 and the second balance weight 24, and a second position fixing member 25, which is fitted into the fastening portion 24*a*, may be provided on the other of the first balance weight 22 and the second balance weight 24.

With the second position fixing member 25, the second balance weight 24 may be fastened and fixed to the first balance weight 22. The guide movable balance weight 22, which is formed as described above, moves a heavier weight while moving along the guide rails 34, and as a result, it is possible to obtain a greater effect in respect to the adjustment of a center of gravity.

For example, as illustrated, the second position fixing member 25 may be configured integrally with the first balance weight 22, and the fastening portion 24*a*, which is in the form of a hole elongated in the movement direction of the second balance weight 24, may be formed in the second balance weight 24. In this case, a screw may be used as the second position fixing member 25 such that the first balance weight 22 and the second balance weight 24 may be screw-fastened to each other, and a head portion of the screw may be placed on a stepped portion 24*b* formed in the fastening portion 24*a*.

The guide movable balance weight 20 may be aligned at a predetermined position, that is, at one side of the movement route 34*a* of the guide by being moved along the movement route 34*a* of the guide, and may then be fixed at the position on the guide rails 34 by the first position fixing member 22*c*.

The fastening member 26 couples the plurality of stacked plate-shaped members so as to form the second balance weight 24, and in this case, the plurality of stacked plate-shaped members may be configured to be easily released so that the plate-shaped members may be added or removed as described above.

For example, as illustrated, a bolt may be used as the fastening member 26, and in this case, a plurality of bolt fastening holes may be formed in the first balance weight 22, the second balance weight 24, and the guide rail 34 so that the first position fixing member 22*c* or the second position fixing member 25, which is the bolt, may be fastened regardless of whether the guide movable balance weight 20 is aligned at any position.

The first position fixing member 22*c* or the second position fixing member 25 may fix the first balance weight 22 and the second balance weight 24 to the guide rail 34 or the first balance weight 22, respectively. The second position fixing member 25 is a member that fastens the first balance weight 22 and the second balance weight 24. That is, the first balance weight 22 and the second balance weight 24 are connected to each other by the second position fixing member 25, thereby forming a mass of the guide movable balance weight 20.

The first balance weight 22 and the second balance weight 24, which form a mass of the guide movable balance weight 20 by the second position fixing member 25, are integrally fixed to the guide rail 34 by the first position fixing member 22*c*. That is, the first position fixing member 22*c* is a member that fixes the guide movable balance weight 20 to the guide rail 34.

The balance weight module may further include first anti-abrasion members 42 and a second anti-abrasion member 44 which are interposed between the guide rail 34 and the guide movable balance weight 20.

The first and second anti-abrasion members 42 and 44 serve to prevent abrasion of the guide rail 34 and the guide movable balance weight 20 which is caused by friction between the guide rail 34 and the guide movable balance weight 20.

The first and second anti-abrasion members 42 and 44 are made of a material having lower rigidity than a material of the guide rail 34 or the guide movable balance weight 20, and particularly, the first and second anti-abrasion members 42 and 44 may be made of a synthetic resin material such as acetal resin.

The first anti-abrasion member 42 is formed in a band shape, and may be attached to the vertical portion 35 of the guide rail 34 in an elongated manner along the movement route of the guide movable balance weight 20.

In addition, the balance weight module may further include the second anti-abrasion member 44 interposed between the guide panel 32 and the guide movable balance weight 20. The second anti-abrasion member 44 is formed in a plate shape, and may be attached to the first member 22*a* of the first balance weight 22.

In addition, the balance weight module may further include a detachable balance weight 60 formed on one surface of the guide panel 32 that faces the guide movable balance weight 20 based on the guide panel 32.

The detachable balance weight 60 may be fixed in position by being coupled to the guide panel 32 by fastening means such as bolts or may be separated by being released from the guide panel 32.

The detachable balance weight 60 may be coupled only at a particular position of the guide panel 32, or the position of the detachable balance weight 60 may be changed. The detachable balance weight 60 may also be configured as a single member, or may be configured by stacking a plurality of members as illustrated. Each of the members of the detachable balance weight 60 may be formed in a plate shape.

Meanwhile, the balance weight module may be coupled directly to the rear surface of the reflector 2 or various types of frames (not illustrated) formed on the rear surface of the reflector 2, but the balance weight module may be supported by being mounted on a balance weight bracket 100 coupled to the rear surface of the reflector 2. The balance weight module may be coupled to the balance weight bracket 100 by fastening means such as bolts or separated from the balance weight bracket 100.

Meanwhile, stopper members 45 may be formed at both ends in a longitudinal direction of the pair of guide rails 34. When the guide movable balance weight 20 is moved, the guide movable balance weight 20 may be moved by the weight thereof and thus deviate from the guide rail 34 in a state in which the first position fixing member 22*c* and the second position fixing member 25 are released. Because an accident may occur if the guide movable balance weight 20 deviates from the guide rail 34, the stopper members 45, as safety devices, may be formed at a total of four positions at both ends in the longitudinal direction of the pair of guide rails 34 in a horizontally symmetrical manner.

An operation of adjusting the weight balance of the reflector 2 according to the present invention may be carried out as follows.

The guide movable balance weight 20 may still remain coupled to the guide even though the engagement between the guide movable balance weight 20 and the guide by the fixing member is released, and as a result, an operator may easily move the guide movable balance weight 20 along the guide without having a burden such as a weight.

In contrast, in order to change a position of the detachable balance weight 60, the detachable balance weight 60 needs to be completely separated from the guide panel 32 by releasing the bolts, the position of the detachable balance weight 60 needs to be aligned, and then the detachable balance weight 60 needs to be fixed to the guide panel 32 by fastening the bolts again. Therefore, the operation of aligning the position of the guide movable balance weight 20 is much easier than the operation of aligning the position of the detachable balance weight 60.

Figure 5:
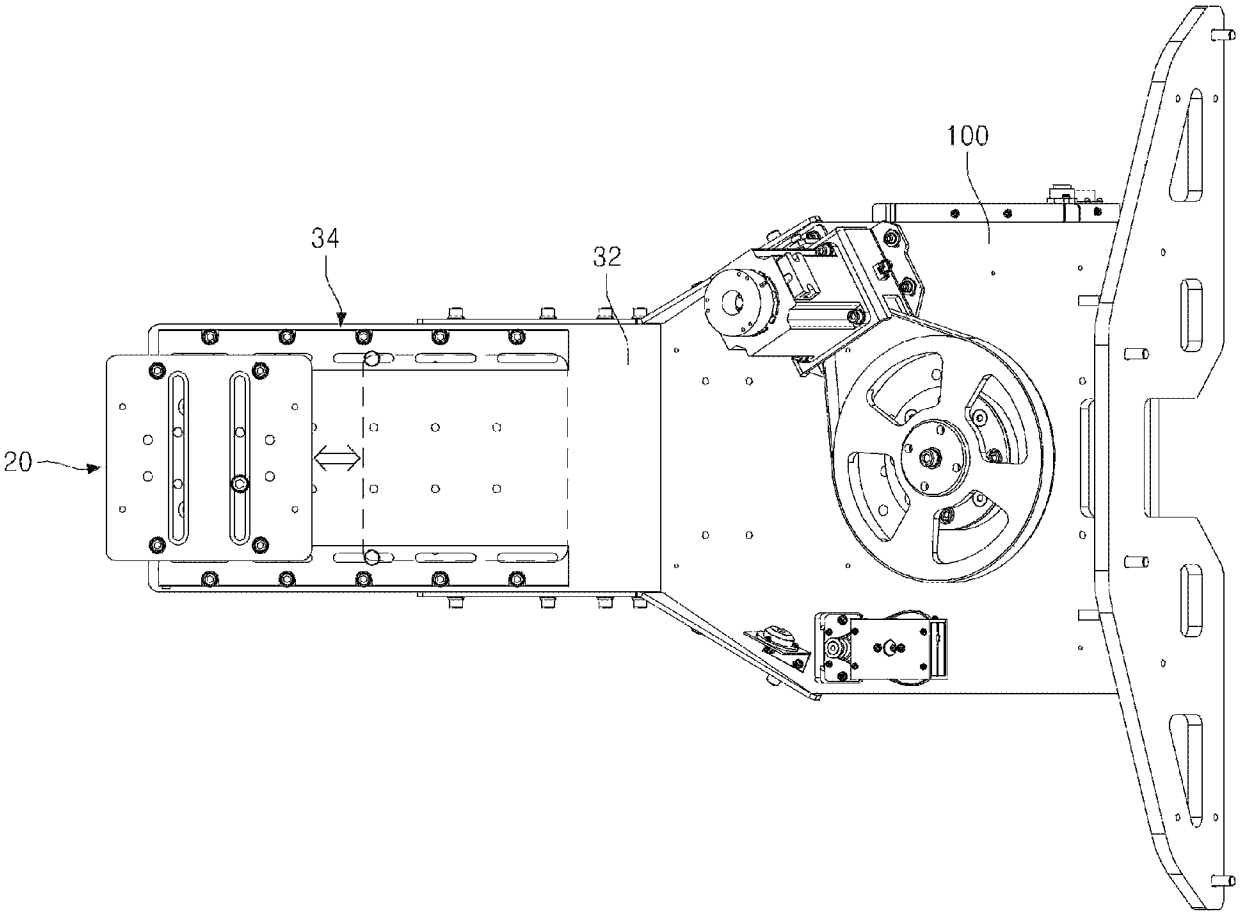
FIGS. 5 and 6 are top plan views of the balance weight module illustrated in FIG. 2, in which a movement of a first balance weight is illustrated.
Figure 6:
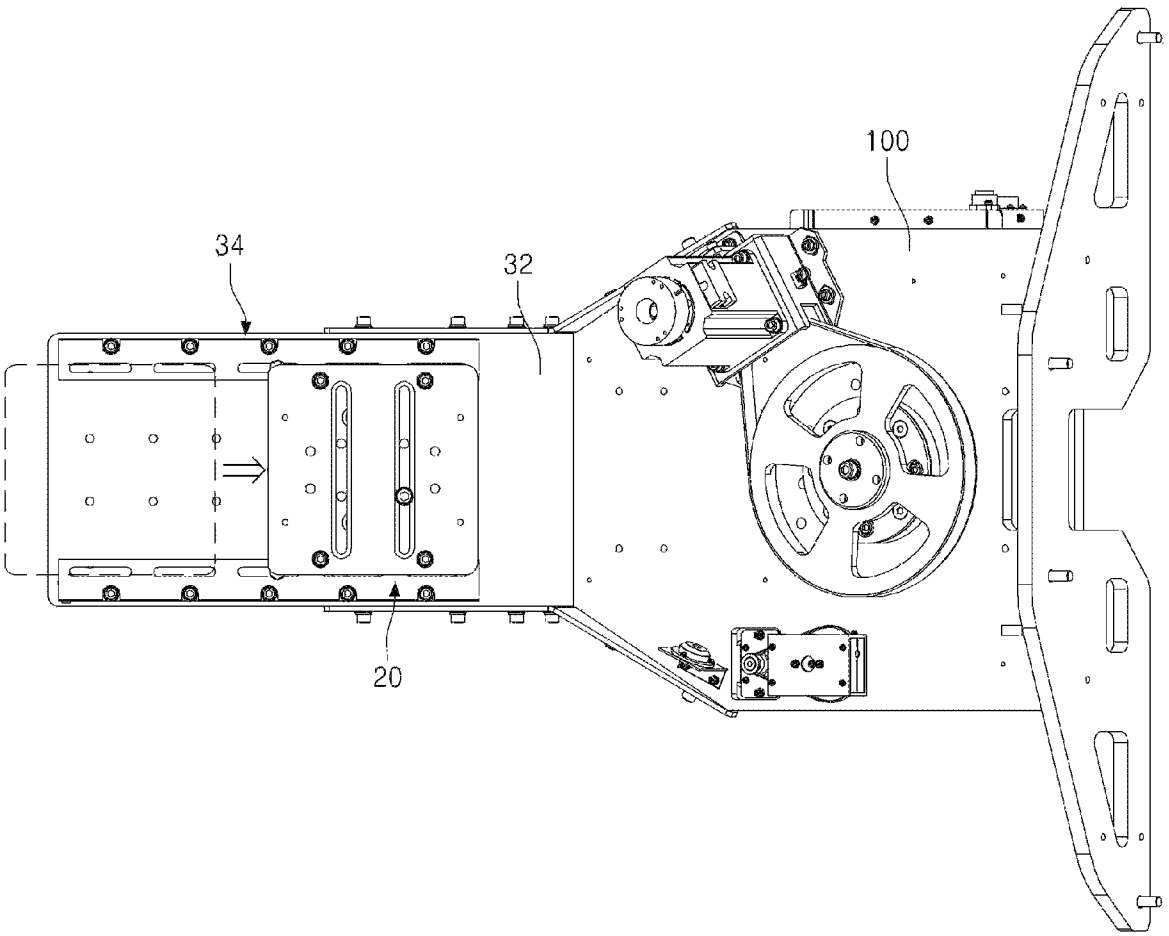
Figure 7:
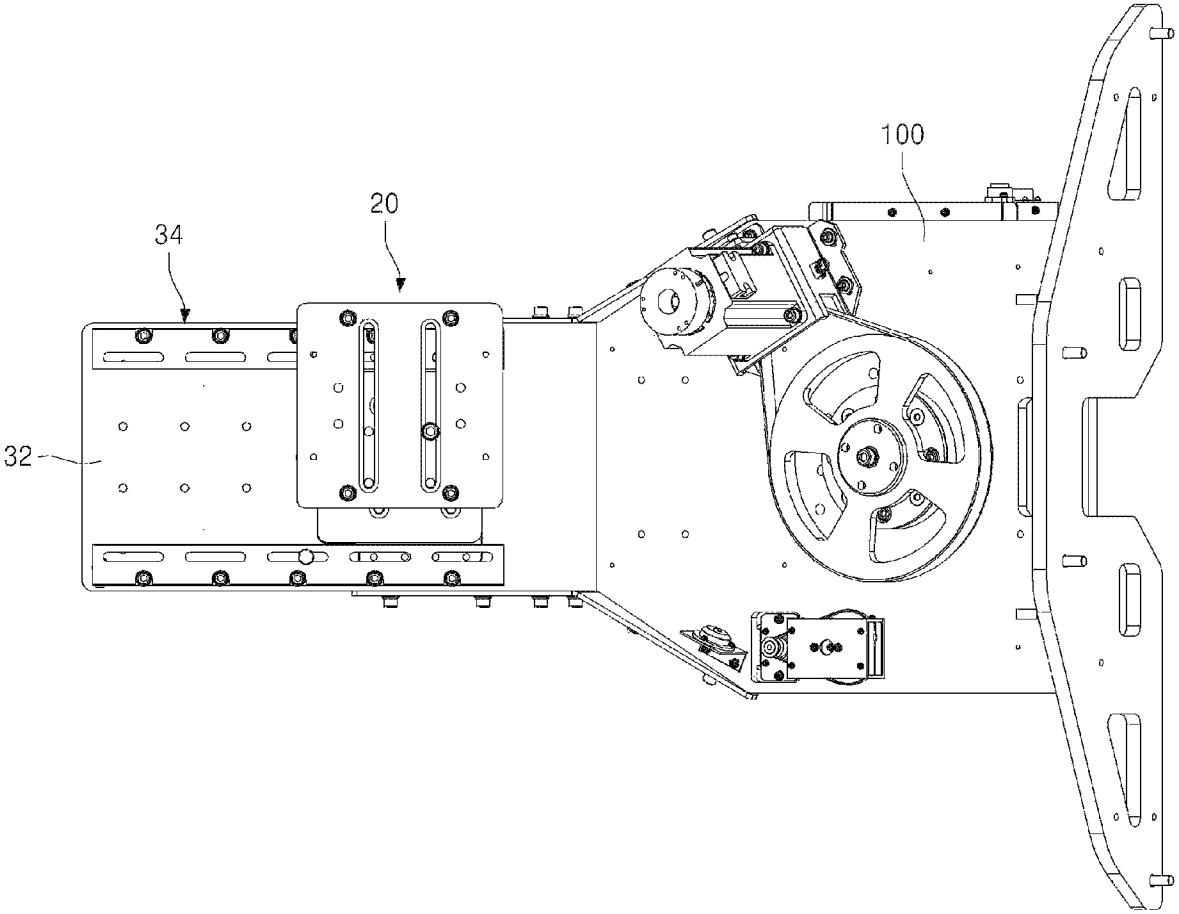
FIGS. 7 and 8 are top plan views of the balance weight module illustrated in FIG. 2, in which a movement of a second balance weight is illustrated.
Figure 8:
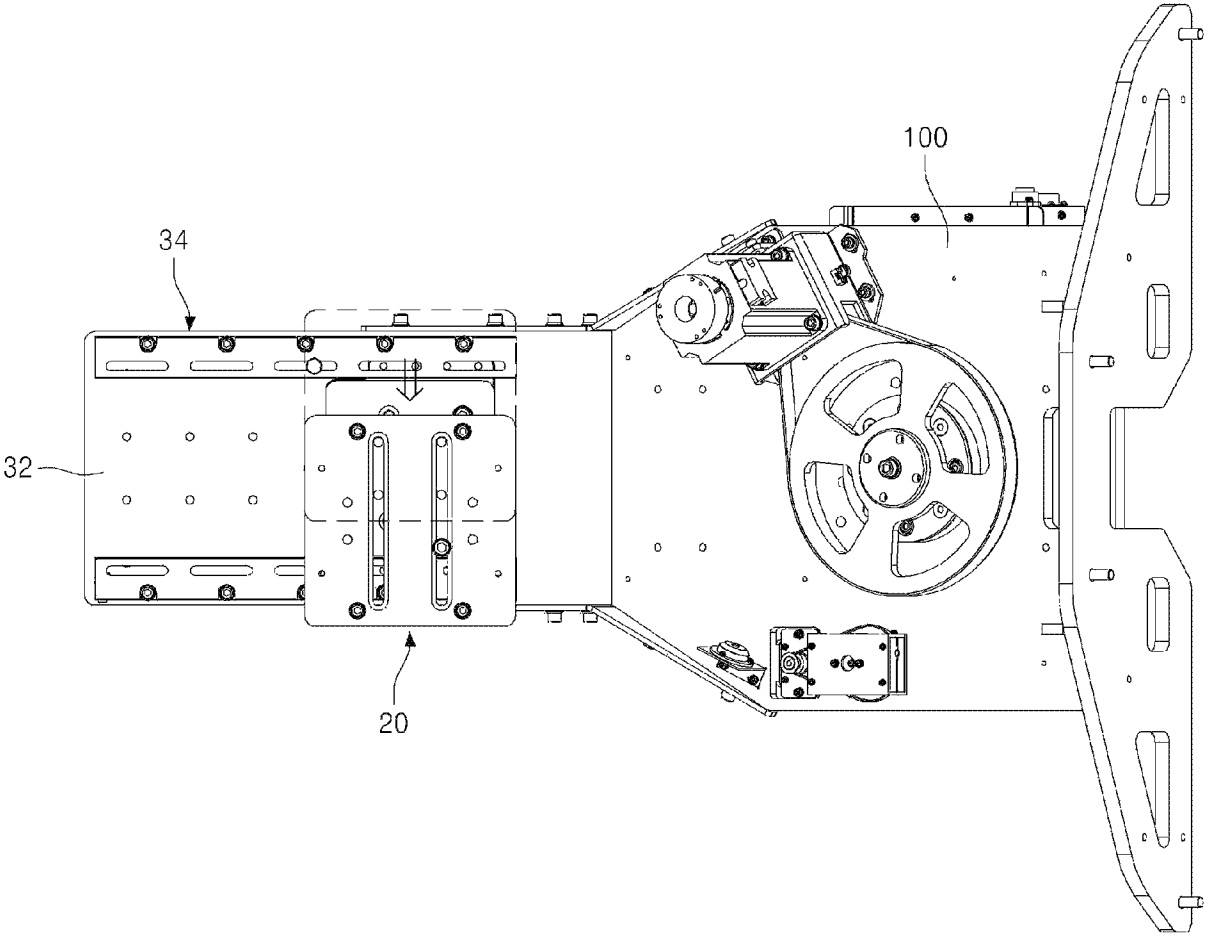

Therefore, first, the basic weight balance of the satellite antenna is adjusted by coupling the detachable balance weight 60 to the guide panel 32. The first balance weight 22 of the guide movable balance weight 20 is then moved along the guide, as illustrated in FIGS. 5 and 6. Then, as illustrated in FIGS. 7 and 8, an operation of precisely adjusting the weight balance of the reflector 2 is performed while moving the second balance weight 24 along the first balance weight 22, and then the guide movable balance weight 20 may be coupled to the guide by the fixing member.

If the weight balance of the reflector 2 needs to be readjusted, the weight balance of the reflector 2 may be easily and quickly readjusted by moving only the guide movable balance weight 20 along the guide in a state in which the detachable balance weight 60 is maintained as it is.

While the exemplary embodiments of the present invention have been described above with reference to particular contents such as specific constituent elements, the limited exemplary embodiments, and the drawings, but the exemplary embodiments are provided merely for the purpose of helping understand the present invention overall, and the present invention is not limited to the exemplary embodiment, and may be variously modified and altered from the disclosure by those skilled in the art to which the present invention pertains. Therefore, the spirit of the present invention should not be limited to the described exemplary embodiment, and all of the equivalents or equivalent modifications of the claims as well as the appended claims belong to the scope of the spirit of the present invention.

INDUSTRIAL APPLICABILITY

The present invention may be used for a satellite antenna or the like mounted on a moving body such as a ship.

The invention claimed is:

1. A satellite antenna comprising:

a reflector which is directed in a direction toward a target satellite and receives a predetermined satellite signal; and a balance weight module which is mounted on a rear surface of the reflector, wherein the balance weight module includes a guide movable balance weight, a guide which defines a movement route along which the guide movable balance weight is moved in a state in which the guide movable balance weight is coupled to the guide, and a fixing member which fixes the guide movable balance weight at one side of the movement route, wherein the guide includes a guide panel which is provided with a guide rail into which both sides of the guide movable balance weight are movably fitted, respectively, and which define the movement route of the guide movable balance weight, and wherein the guide movable balance weight includes a first balance weight which is coupled to the guide rail and moved along the guide rail, and a second balance weight which is moved relative to the first balance weight in a direction different from a direction in which the first balance weight is moved in a state in which the second balance weight is coupled to the first balance weight.

2. The satellite antenna of claim 1, wherein an oblong hole, which has a hole shape elongated along the movement route of the guide movable balance weight, is formed in the guide rail, and the guide movable balance weight is provided with a first position fixing member which is movably fitted into the oblong hole of the guide rail and fixed to the guide panel.

3. The satellite antenna of claim 1, further comprising:

anti-abrasion members which are attached to the guide panel, the guide rail, or the guide movable balance weight so as to be interposed between the guide panel and the guide movable balance weight and between the guide rail and the guide movable balance weight.

4. The satellite antenna of claim 1, wherein the movement direction of the second balance weight is perpendicular to the movement direction of the first balance weight.

5. The satellite antenna of claim 1, wherein a groove or hole-shaped fastening portion is formed in at least one of the first balance weight and the second balance weight, and the first balance weight and the second balance weight are fastened and fixed to each other by a second position fixing member fitted into the fastening portion.

6. The satellite antenna of claim 1, wherein the balance weight module further includes a detachable balance weight formed on one surface of the guide panel which faces the guide movable balance weight based on the guide panel.

7. The satellite antenna of claim 1, further comprising:

a balance weight bracket which is formed at a rear side of the reflector and supports the balance weight module.

* * * * *